US007784309B2

(12) United States Patent
Hwang et al.

(10) Patent No.: US 7,784,309 B2
(45) Date of Patent: Aug. 31, 2010

(54) LAUNDRY MACHINE

(75) Inventors: Sung Gi Hwang, Changwon-si (KR); Ju Han Yoon, Changwon-si (KR); Seong Kyu Kim, Changwon-si (KR); Seon Il Heo, Changwon-si (KR)

(73) Assignee: LG Electronics Inc., Seoul (KR)

( * ) Notice: Subject to any disclaimer, the term of this patent is extended or adjusted under 35 U.S.C. 154(b) by 228 days.

(21) Appl. No.: 11/848,747

(22) Filed: Aug. 31, 2007

(65) Prior Publication Data

US 2008/0053160 A1 Mar. 6, 2008

(30) Foreign Application Priority Data

Sep. 5, 2006 (KR) ..... 10-2006-0085127

(51) Int. Cl.
*D06F 33/00* (2006.01)

(52) U.S. Cl. ..... 68/12.01

(58) Field of Classification Search ..... 68/12.01
See application file for complete search history.

(56) References Cited

U.S. PATENT DOCUMENTS 5,579,035 A * 11/1996 Beiswenger ..... 345/169
5,748,270 A * 5/1998 Smith ..... 349/69
5,995,877 A * 11/1999 Brueggemann et al. ..... 700/85
2004/0150303 A1* 8/2004 Park et al. ..... 312/265.6

FOREIGN PATENT DOCUMENTS

CN 1540068 A 10/2004

OTHER PUBLICATIONS

Chinese Office Action dated Jul. 10, 2009.

* cited by examiner

*Primary Examiner*—Michael Cleveland
*Assistant Examiner*—Samuel A Waldbaum
(74) *Attorney, Agent, or Firm*—KED & Associates, LLP

(57) ABSTRACT

The present invention relates to a laundry machine having control panel to which a display secured. A laundry machine including a control panel in which a display for displaying operational conditions is provided, the laundry machine includes a mounting part provided in a predetermined portion of the control panel to mount the display therein, at least one insert groove provided at the mounting part, and an insert protrusion provided at the display, corresponding to the at least one insert groove.

6 Claims, 3 Drawing Sheets

LAUNDRY MACHINE

CROSS REFERENCE TO RELATED APPLICATION

This application claims the benefit of the Patent Korean Application No. 10-2006-0085127, filed on Sep. 5, 2006, which are hereby incorporated by reference as if fully set forth herein.

BACKGROUND OF THE DISCLOSURE

1. Field of the Disclosure

The present invention relates to a laundry machine. More particularly, the present invention relates to a laundry machine having a control panel to which a display is secured.

2. Discussion of the Related Art

Laundry machines are typically electric appliances that can perform washing, drying or both washing and drying of laundry including clothes, cloth items and beddings. Here, a single laundry machine may perform only washing or drying, or both washing and drying. Recently, a kind of laundry machine including a steam supply device has been consumed, which has functions of wrinkle removal, bad smell removal, static electricity removal and refreshing.

As follows, in reference to drawings, an exterior appearance of a conventional laundry machine will be explained.

FIG. 1 illustrates a control panel secured to a conventional laundry machine. FIG. 2 illustrates a display coupled to the control panel. FIG. 3 is a sectional view schematically illustrating a state of the display being coupled to the control panel.

In reference to FIGS. 1 to 3, the conventional laundry machine includes a case 10, a panel frame 30, a control panel 20 and a top cover 40. The case 10 defines a front of an exterior appearance of the laundry machine. The panel frame 30 is provided at a front of an upper portion of the case 10. The control panel 20 is coupled to the panel frame 30. The top cover 40 is provided on the case 10.

The control panel 20 includes input buttons 7, a rotary knob 3 and a display 5. A user inputs functions by using the input buttons 7 and operational conditions of the laundry machine are displayed on the display 5.

Coupling frames 32 and 34 having a bent structure are provided at both sides of the panel sides, respectively. A screw hole 38 is formed at one side of each coupling frame 32 and 34 to allow the coupling frames to be screw-coupled to the control panel 20. Screw holes 27 corresponding to the screw holes 38 of the coupling frames 32 and 34 are formed at predetermined portions of the control panel 20, respectively.

In addition, a mounting part 21 is provided at the control panel 20 and the display 5 is mounted in the mounting part 21. A securing hook 22 is provided at an upper and lower portion of the mounting part 21 to secure the display 5 to the mounting part 21.

As a result, since the display 5 is mounted in the mounting part 21 and secured by the securing hook 22, the display 5 is coupled to the control panel 20 securely.

However, the conventional laundry machine having the above structure might have problems.

As shown in FIG. 3, a user might see the lower securing hook, when seeing the display from an outside. As a result, a user has difficulty in seeing information on the display and also exterior beauty might not be deteriorated.

SUMMARY OF THE DISCLOSURE

Accordingly, the present invention is directed to a laundry machine.

An object of the present invention is to provide a laundry machine having a structure in that coupling between a display and a control panel is not shown from an outside.

Additional advantages, objects, and features of the disclosure will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a laundry machine including a control panel in which a display for displaying operational conditions is provided, the laundry machine includes a mounting part provided in a predetermined portion of the control panel to mount the display therein; at least one insert groove provided at the mounting part; and an insert protrusion provided at the display, corresponding to the at least one insert groove.

It is preferable that the laundry machine further includes at least one securing hook provided at an upper portion of the mounting part to secure the display to the control panel. As a result, the display may be coupled to the control panel securely.

Here, the insert groove may be provided at a lower surface of the mounting part or at both opposite sides of the mounting part.

If the insert groove is provided at the lower surface of the mounting part, one of the at least one insert groove is recessed only in a downward direction of the control panel and other one of the at least one insert groove is recessed in a downward and rearward direction of the control panel. As a result, the display can be coupled to the control panel securely.

If the insert groove is provided at both opposite side surfaces of the mounting part, one of the at least one insert groove is recessed only in a sideward direction of the control panel and other one of the at least one insert groove is recessed in a sideward and rearward direction of the control panel. As a result, the display may be coupled to the control panel securely.

The laundry machine may further include a separation-preventing part provided at the control panel to prevent the display from being separated in a forward direction of the control panel.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DESCRIPTION OF SPECIFIC EMBODIMENTS

Reference will now be made in detail to the specific embodiments of the present invention, examples of which are illustrated in the accompanying drawings. Wherever possible, the same reference numbers will be used throughout the drawings to refer to the same or like parts.

Figure 4:
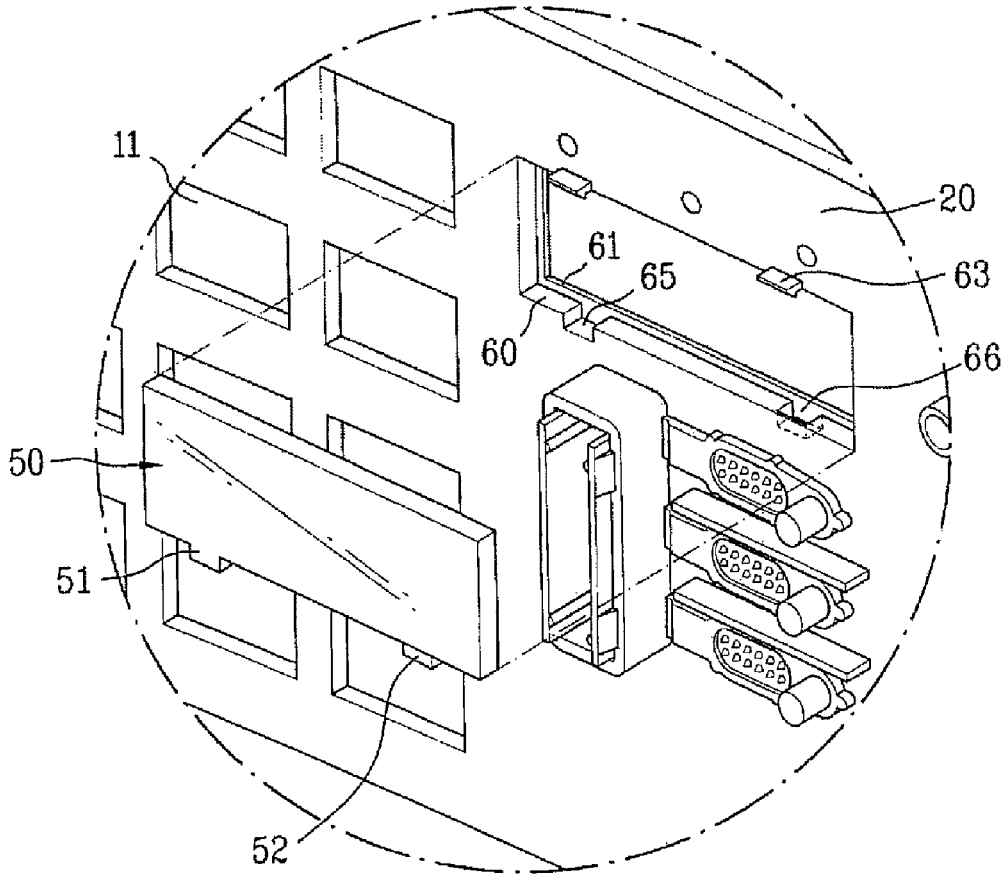
FIG. 4 is a diagram illustrating a state in that a display is coupled to a control panel in a laundry machine according to an embodiment of the present invention.

FIG. 4 illustrates a state in that a display is coupled to a control panel in a laundry machine according to an embodiment of the present invention.

In reference to FIG. 4, the laundry machine according to the embodiment includes a control panel 20 having various buttons 7 for inputting operational functions, and a display 50 for displaying operational conditions.

The control panel 20 may be directly provided on a top of the case 10 or may be provided at an auxiliary panel frame 30 provided at a front surface of the case 10.

If the control panel 20 is directly installed at the case 10, a coupling hole (not shown) corresponding to a screw hole 27 of the control panel 20 may be provided at the case 10.

Button holes 11 are formed at the control panel 20 and each button 7 is inserted in each corresponding button hole 11. A mounting part 60 may be provided at the control panel 20 and the display 50 is mounted in the mounting part 60.

Here, the display 50 is mounted in the mounting part 60 to be secured to the control panel 20. A size and shape of the mounting part 60 is formed corresponding to those of the display 50. Although FIG. 4 presents a rectangular shaped mounting part 60 and display 50, the present invention is not limited thereto.

The mounting part 60 may be configured of a predetermined groove in which the display 50 is mounted. At this time, a lower surface of the groove-shaped mounting part 60 toward a front portion of the control panel 20 may be formed of transparent material. As a result, a user can see information displayed on the display 50 outside.

On the other hand, the mounting part 60 may be configured of a predetermined hole in which the display 50 is inserted. In this case, a user can directly see the information displayed on the display 50 mounted in the mounting part 60. Here, it is preferable that a separation preventing part 61 is provided at a front portion of the mounting part 60 to prevent the display 50 from separating toward a front of the control panel 20.

In addition, at least one insert groove 65 and 66 may be formed at the mounting part 60, and an insert protrusion 51 and 52 corresponding to the insert groove 65 and 66 may be formed at the display 50.

As a result, the insert protrusion 51 and 52 is inserted in the insert groove 65 and 66 to mount and secure the display 50 in the mounting part 60. Also, a user cannot see the insert groove 65 and 66 and insert protrusion 51 and 52 outside, which results in a clean exterior appearance.

Specifically, the conventional laundry machine has a problem that a coupling structure between the display 50 the control panel 20 is visible, and thus the problem is solved in the present invention such that an exterior design of a product may be enhanced.

It is preferable that at least one securing hook 63 is projected from an upper portion of the mounting part 60 in a rearward direction of the control panel 20 and thus the display 50 is mounted in the mounting part 60 securely.

As a result, as the display 50 is mounted in the mounting part 60 forcibly inward the securing hook 63, the display 50 may be coupled to the control panel 20 securely.

Here, since the securing hook 63 is provided at the upper portion of the mounting part 60, a user cannot see the securing hook 63. Commonly, the position where the user see the display 50 is higher or horizontal than or to the position of the display 50. Thus, if the securing hook 63 is provided at the upper portion of the mounting part 60 as mentioned above, a user cannot see the securing hook 63 from an outside.

As shown in FIG. 4, the insert grooves 65 and 66 may be provided at a lower surface of the mounting part 60. Either of the insert grooves 65 and 66, that is, a first insert groove 65 may be recessed downward and rearward. The other insert groove, that is, a second insert groove 66 may be recessed downward.

If then, the work of mounting the display 50 in the mounting part 60 may be performed smoothly. Since the first insert groove 65 recessed in a rearward direction of the control panel 20, a first insert protrusion 51 may be inserted in the corresponding first insert groove 65 first. In a state that the first insert protrusion 51 is inserted in the first insert groove 65, a second insert protrusion 52 may be inserted in the corresponding second insert groove 66 smoothly.

The display 50 may be mounted in the mounting part 60 without being separated in a rearward direction of the control panel 20, because the display 50 is mounted in the mounting part 60 and the second insert groove 66 is recessed only downward.

At this time, it is preferable that the second insert groove 66 is formed with a predetermined spare space, so that the second protrusion 52 is inserted in the second insert groove 66 smoothly after the first insert protrusion 51 is inserted in the first insert groove 65.

Figure 5:
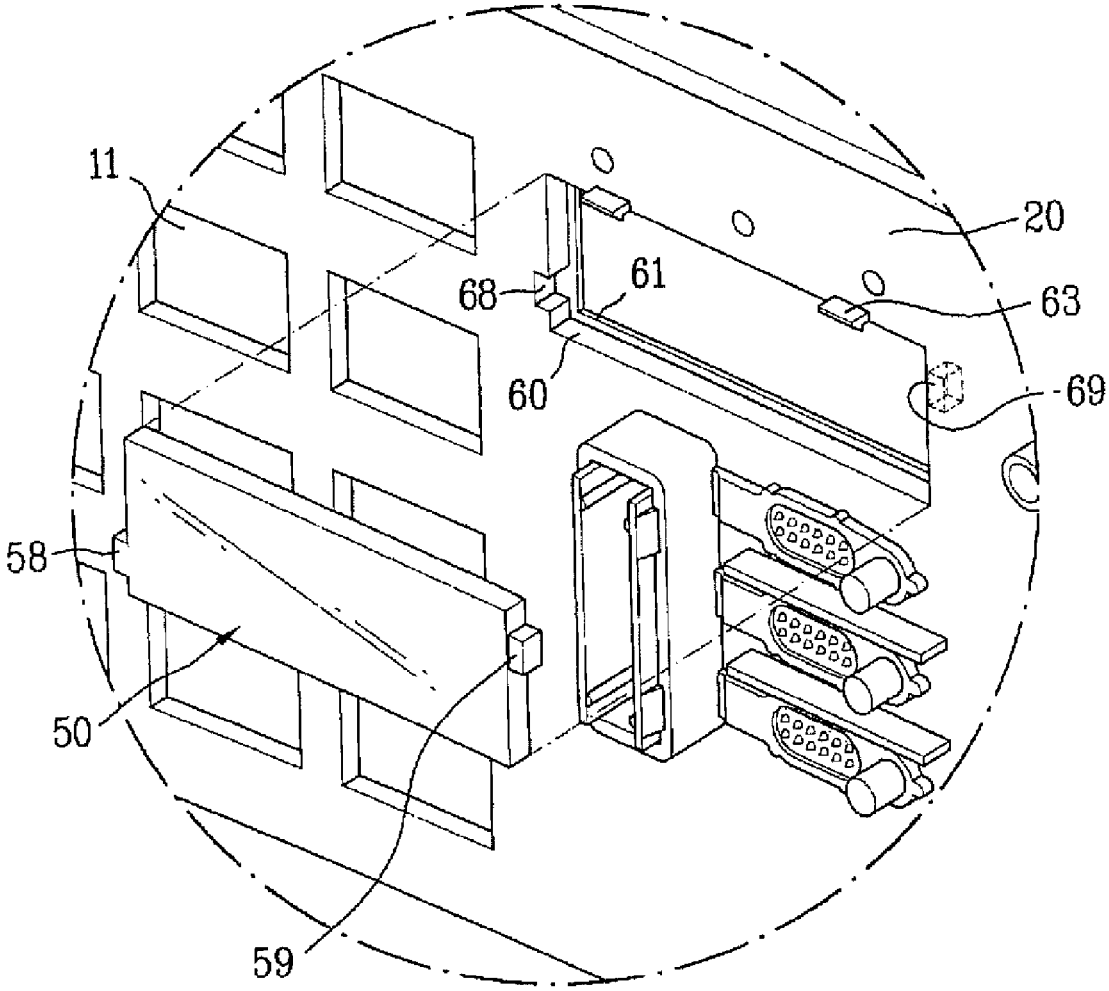
FIG. 5 is a diagram illustrating a state in that a display is coupled to a control panel in a laundry machine according to another embodiment of the present invention.

FIG. 5 illustrates a state in that a display is coupled to the control panel in a laundry machine according to another embodiment of the present invention.

This embodiment is different from the above embodiment except the positions of the insert grooves and the insert protrusions. Thus, the other explanations and numeral references are identical to those of the above embodiment.

In reference to FIG. 5, insert grooves 68 and 69 are provided at both opposite side surfaces of the mounting part 60, respectively. Insert protrusions 58 and 59 are provided at both opposite side surfaces, respectively, to correspond to the insert grooves 68 and 69.

Here, a first insert groove 68 provided at either side surface of the mounting part 60 is recessed in a sideward and rearward direction of the control panel 20. The second insert groove 69 provided at the other side surface of the mounting part 60 is recessed only in a sideward of the control panel 20.

If then, the work of mounting the display 50 in the mounting part 60 can be performed smoothly as mentioned in FIG. 4.

As mentioned above, the laundry machine according to the present invention may enhance the exterior design by not showing a user the inner structure for coupling the display to the control panel.

Next, the coupling process between the display 50 and the control panel 20 in the laundry machine according to the embodiments will be explained.

First, each insert protrusion 51 and 52 of the display 50 is inserted in its corresponding insert groove 65 and 66 provided at the control panel 20.

At this time, the second insert groove 66 has a predetermined spare space rather than its corresponding second insert protrusion 52. As a result, the display 50 may be rotated a predetermined distance, in a state of the second protrusion 52 being inserted in the second insert groove 66.

That is, the upper portion of the display 50 is insertedly secured to the securing hook 63 by rotating the display 50.

Figure 1:
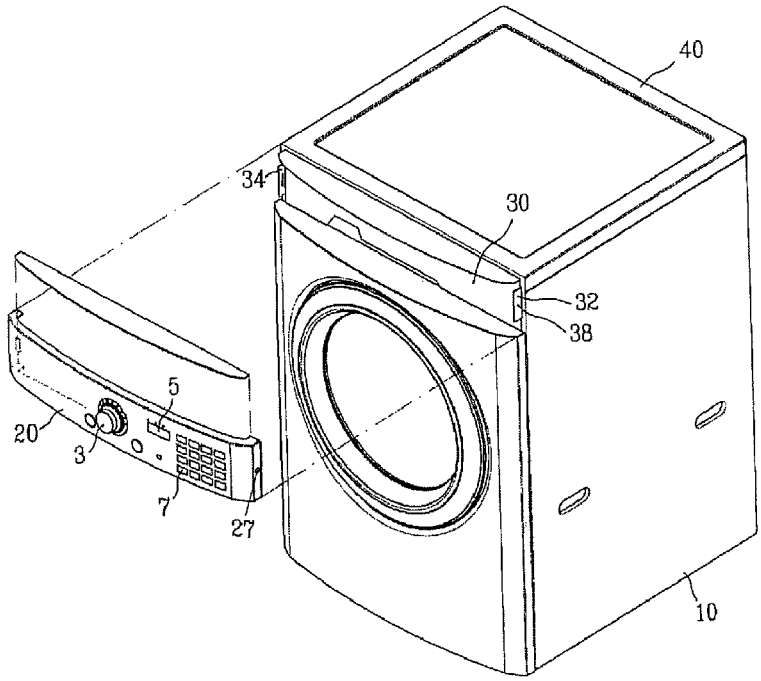
FIG. 1 is a diagram illustrating a control panel coupled to a conventional laundry machine.
Figure 2:
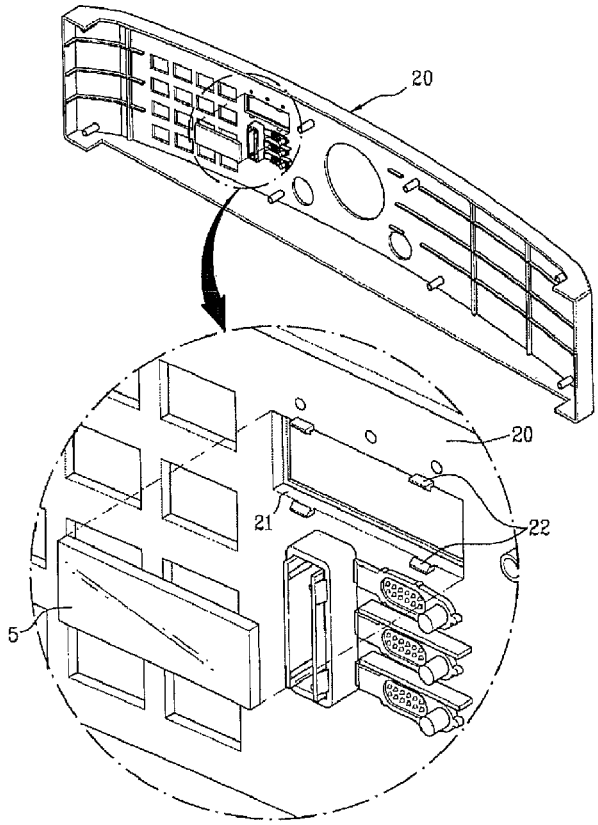
FIG. 2 is a diagram illustrating a state in that a display is getting coupled to the control panel.
Figure 3:
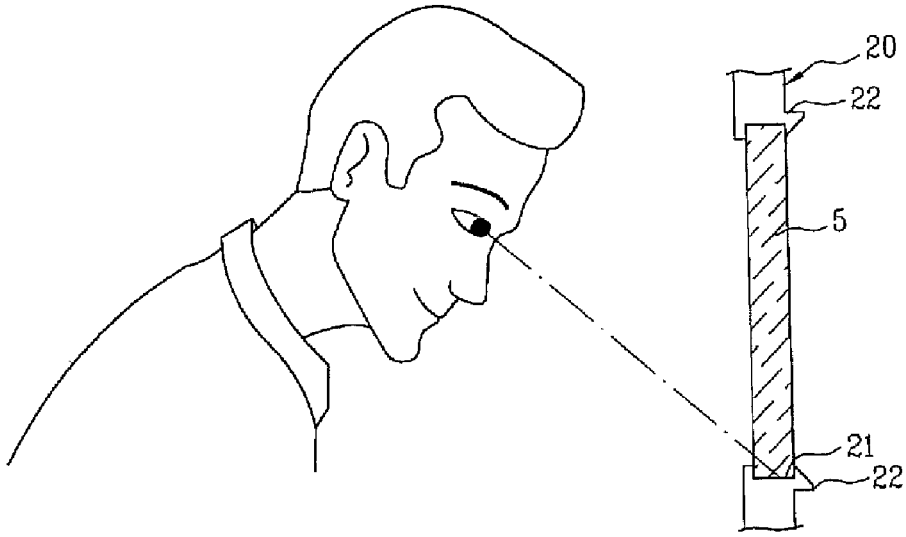
FIG. 3 is a sectional view schematically illustrating a state in that the display is coupled to the control panel shown in FIG. 1.

Hence, the control panel 20 is coupled to the case (10, see FIG. 1) or the panel frame (30, see FIG. 1).

As a result, since the securing hook 63 provided at the upper portion of the mounting part 60 in which the display 50 is mounted, the user cannot see the securing hook 63, the insert grooves provided at the lower or side surface of the mounting part 60 and the insert protrusions inserted in the insert grooves, such that the exterior design of the laundry machine can be enhanced.

Meanwhile, this embodiment presents the rectangular shaped display 50 and mounting part 60. However, various shapes of displays or mounting parts, including circular-shaped ones, may be possible.

In addition, the embodiment presents that the insert groove is provided at the lower or side surface of the mounting part 60. However, the insert groove may be provided at both the lower surface and the side surface. It is preferable that the insert groove is provided at the lower surface or the side surface of the mounting part 60 as mentioned above, only to facilitate the display 50 to be mounted in the mounting part 60 smoothly.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A laundry machine including a control panel in which a display for displaying operational conditions is provided, the laundry machine comprising:

a mounting part provided in a predetermined portion of the control panel to mount the display therein;

at least two insert grooves provided at the mounting part;

an insert protrusion provided at the display, corresponding to at least one of the two insert grooves; and a separation-preventing part provided at the control panel to prevent the display from being separated in a forward direction of the control panel, wherein a first one of the at least two insert grooves is recessed only in an outward direction of the control panel and a second one of the at least two insert grooves is recessed in an outward and rearward direction of the control panel, and wherein the at least two insert grooves and the insert protrusion are formed to be shielded by the separation-preventing part.

2. The laundry machine of claim 1, further comprising:

at least one securing hook provided at an upper portion of the mounting part to secure the display to the control panel.

3. The laundry machine of claim 2, wherein the insert groove is provided at a lower surface of the mounting part.

4. The laundry machine of claim 3, wherein one of the at least two insert grooves is recessed only in a downward direction of the control panel and other one of the at least two insert grooves is recessed in a downward and rearward direction of the control panel.

5. The laundry machine of claim 2, wherein the at least two insert grooves are provided in at least one side surface of the mounting part, respectively.

6. The laundry machine of claim 5, wherein one of the at least two insert grooves is recessed only in a sideward direction of the control panel and other one of the at least two insert grooves is recessed in a sideward and rearward direction of the control panel.

* * * * *